United States Patent [19]

Funk

[11] Patent Number: 4,477,260

[45] **Date of Patent: * Oct. 16, 1984**

[54] PROCESS FOR PREPARING A CARBONACEOUS SLURRY

[75] Inventor: James E. Funk, Alfred Station, N.Y.

[73] Assignee: Alfred University Research Foundation, Inc., Alfred, N.Y.

[ * ] Notice: The portion of the term of this patent subsequent to Aug. 28, 2001 has been disclaimed.

[21] Appl. No.: 527,277

[22] Filed: Aug. 29, 1983

Related U.S. Application Data

[63] Continuation-in-part of Ser. No. 375,183, May 5, 1982, Pat. No. 4,441,887, which is a continuation-in-part of Ser. No. 288,737, Jul. 31, 1981, Pat. No. 4,416,666, which is a continuation-in-part of Ser. No. 088,815, Oct. 26, 1979, Pat. No. 4,282,006, which is a continuation-in-part of Ser. No. 957,166, Nov. 2, 1978, abandoned, which is a continuation-in-part of Ser. No. 790,337, Apr. 25, 1977, abandoned.

[51] Int. Cl.[3] ..... C10L 1/32

[52] U.S. Cl. ..... 44/51

[58] Field of Search ..... 44/51

[56] References Cited

U.S. PATENT DOCUMENTS 4,104,358 8/1978 Cole et al. ..... 44/51

4,282,006 4/1981 Funk ..... 44/51

*Primary Examiner*—Mrs. Y. Harris-Smith

*Attorney, Agent, or Firm*—Howard J. Greenwald

[57] ABSTRACT

A process for preparing a carbonaceous slurry which utilizes a reduced amount of dispersing agent is provided. In this process, a grinding mixture which is comprised of from about 60 to about 82 volume percent of carbonaceous solid material and from about 18 to about 40 volume percent of carrier liquid is provided. The optimum concentration of dispersing agent for this grinding mixture is then determined by a specified method. Thereafter, the grinding mixture is ground until a slurry with specified properties and a specified particle size distribution is obtained; during the grinding, a total of from about 10 to about 90 weight percent of the optimum concentration of dispersing agent is added to the grinding mixture by adding at least two separate portions of dispersant at at least two separate times.

19 Claims, 2 Drawing Figures

PROCESS FOR PREPARING A CARBONACEOUS SLURRY

CROSS-REFERENCE TO RELATED APPLICATIONS

This application is a continuation-in-part of applicant's copending application Ser. No. 375,183 May 5, 1982, now U.S. Pat. No. 4,441,887 which was a continuation-in-part of application Ser. No. 288,737 filed July 31, 1981, now U.S. Pat. No. 4,416,666 which was a continuation-in-part of application Ser. No. 088,815 filed Oct. 26, 1979 (now U.S. Pat. No. 4,282,006), which was a continuation-in-part of application Ser. No. 957,166 filed Nov. 2, 1978 (now abandoned), which was a continuation-in-part of application Ser. No. 790,337 filed Apr. 25, 1977 (now abandoned).

TECHNICAL FIELD

A process for preparing a carbonaceous slurry which utilizes a reduced amount of dispersing agent is disclosed. In this process, a grinding mixture which is comprised of from about 60 to about 82 volume percent of carbonaceous solid material is provided. The optimum concentration of dispersing agent for this grinding mixture is then determined by a specified test. Thereafter, the grinding mixture is ground until a slurry with specified properties and a specified particle size distribution is obtained; during the grinding, a total of from about 10 to about 90 weight percent of the optimum concentration of dispersing agent is added to the grinding mixture by adding at least two separate portions of dispersant at least two separate times.

BACKGROUND OF THE INVENTION

U.S. Pat. No. 4,282,006 discloses a unique, carbonaceous slurry which, despite the fact that it contains at least 55 weight percent of solid material, is readily pumpable and has a relatively low viscosity. The slurry described in this patent has outstanding stability properties, and it can be burned without being dewatered.

The slurry described in U.S. Pat. No. 4,282,006 contains at least one dispersing agent. In order to be economically competitive, the price of said slurry should be competitive with the price of an equivalent amount of fuel oil. To that end, the amount of the dispersing agent in the slurry should be minimized, for the dispersing agent is generally one of the more expensive components of the slurry.

It is thus an object of this invention to provide a process for producing a carbonaceous slurry with properties substantially as good as those of the slurry of U.S. Pat. No. 4,282,006 wherein the amount of dispersing agent used in preparing such a slurry is substantially reduced.

SUMMARY OF THE INVENTION

In accordance with this invention, there is provided a process for preparing a carbonaceous slurry. In the first step of this process, a carbonaceous mixture which contains from 60 to 82 volume percent of solid material is provided. The mixture is then ground until it contains at least 5 weight percent of colloidal carbonaceous particles, has a specified particle size distribution, has a Brookfield viscosity of less than 5,000 centipoise, at 60% solids, and has certain other specified properties. During the grinding of the mixture, from about 10 to about 90 weight percent of the optimum amount of dispersing agent for the slurry, as determined by a specified test, is added in at least two separate portions at at least two separate times.

BRIEF DESCRIPTION OF THE DRAWINGS

The present invention will be more fully understood by reference to the following detailed description hereof, when read in conjunction with the attached drawings, wherein like reference numbers refer to like elements and wherein.

DESCRIPTION OF THE INVENTION

Figure 1:
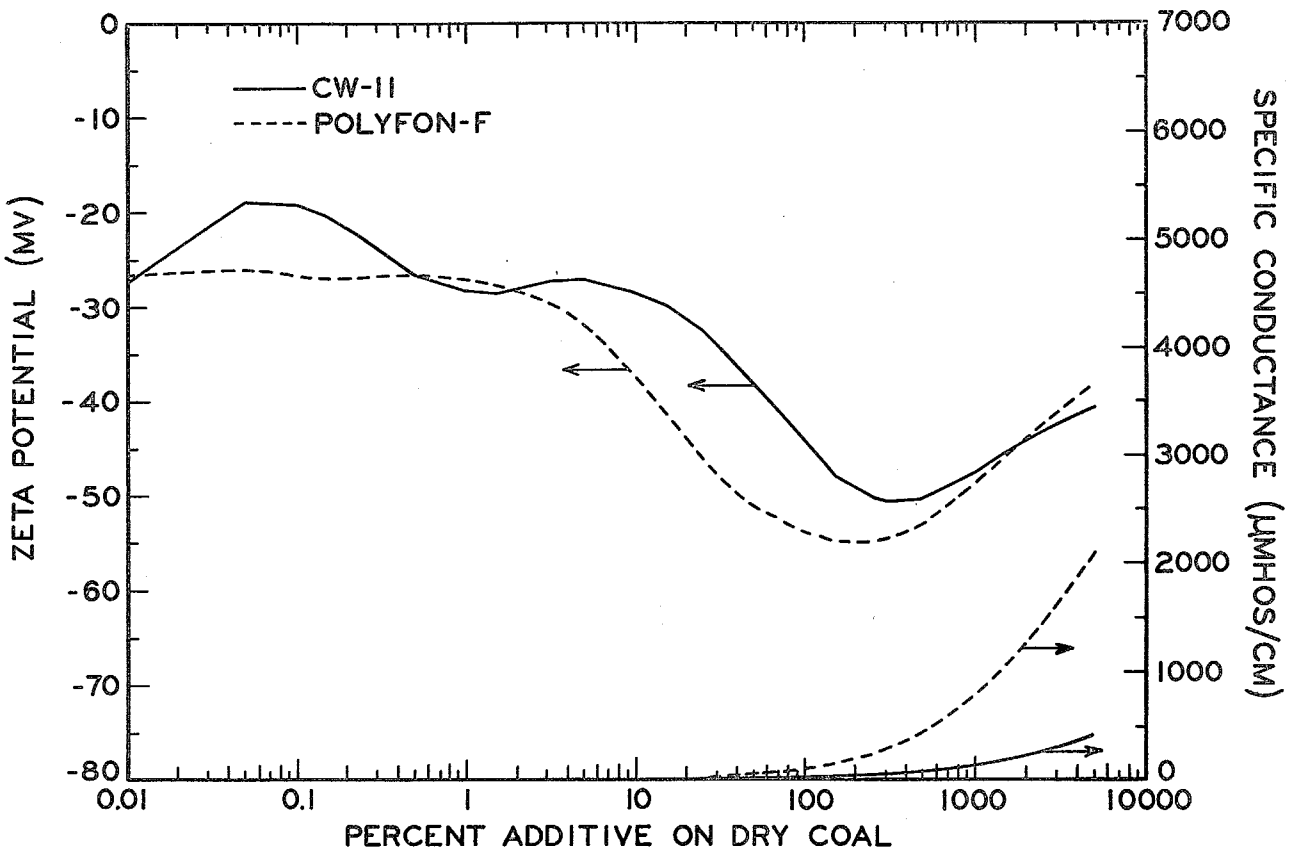
FIG. 1 is a chart showing the correlation between the zeta potential of coal particles in a fluid and the specific conductance of the fluid as a function of percent dispersing agent for two candidate dispersants.

The process of this invention comprises the steps of providing a specified grinding mixture and, while grinding it to obtain a slurry with specified properties, adding from about 10 to about 90 weight percent of the optimum amount of dispersing agent to it in at least two separate portions at at least two separate times.

In the first step of the process of this invention, a grinding mixture comprised of from about 60 to about 82 volume percent of carbonaceous solid material and from about 18 to about 40 volume percent of carrier liquid is provided.

The grinding mixture used in the process of this invention is comprised of at least one carbonaceous solid. As used in this specification, the term "carbonaceous" refers to a carbon-containing material and includes, e.g., coal, coke, graphite, and the like. The preferred carbonaceous materials are carbonaceous fuels.

In one preferred embodiment, the carbonaceous solid is coal. The kind of coal used for practice of the invention is not critical. Coals found in the United States, particularly low volatile bituminous coals from West Virginia, high volatile bituminous coals from Kentucky, Ohion, Arizona, or sub-bituminous coals from Montana fields have been used. Anthracite, semi-anthracite, medium, and high-volatile bituminous, sub-bituminous and lignite coals also may advantageously be used to practice the invention.

The coal for use in the process can be obtained in a dry or wet form and mixed with fluid to form a coal-fluid mixture. Preferably, the coal for making a fine particle sized fraction is wet milled in known ways to prevent dust and explosion hazards.

In view of the manner in which coal fractures during milling, coal particles will have irregular shapes which, however, are of a body (or maximum side-to-side thickness) such that the sub-sieve sized discrete particles will pass through a specified mesh of a sieve. The size of the discrete particle can be expressed in terms of a spherical diameter which, as used herein, is defined as a U.S. sieve size of from 16 mesh to 400 mesh (38 $\mu$m) or its equivalent in microns through which a coal particle from a sample of coal or coal-water slurry will pass. For particles finer than 200 mesh, the size of the particles can be expressed in $\mu$m as determined by means of a sieve, or a sedimentometer, or a scanning electron microscope (SEM).

In one preferred embodiment, the carbonaceous solid is coke. Coke is the carbonaceous residue (70–80%) of a carbonaceous material (such as coal) after the volatile components have been distilled off. Any coke known to those skilled in the art can be used in the slurry of this invention. Thus, for example, one can use coke formed when bituminous coal is heated in either a limited air supply or in the absence of air. Petroleum coke, made from the fractionation of oil, also can be used in the slurry of this invention.

Mixtures of carbonaceous solids also can be used in the mixture of this invention. By way of illustration and not limitation, one can use a mixture of a coarse carbonaceous fraction which contains less than about 30 weight percent of volatilizable hydrocarbons (such as, e.g., anthracite or low volatile bituminous coal) and a fine carbonaceous fraction which contains more than about 35 weight percent of volatilizable hydrocarbons (such as, e.g., lignite or high volatile bituminous coal). One can use a mixture of two or more of said coarse carbonaceous fractions and one of said fine fractions, one of said coarse carbonaceous fractions and two or more of said fine fractions, or two or more of said coarse carbonaceous fractions and two or more of said fine fractions.

The grinding mixture used in the process of this invention is comprised of one or more liquids. As used in this specification, the term liquid refers to a substance which undergoes continuous deformation under a shearing stress. The liquid used in the slurry of this invention preferably performs at least two functions—it fills the interstitial pores of the carbonaceous solid material, and it provides the vehicle for separation of the particles of the carbonaceous solid material to minimize collisions between said particles; thus, the preferred liquid is a carrier liquid.

By way of illustration and not limitation, some of the liquids which can be used includes water; waste industrial solvents such as, e.g., effluents from waste disposal plants, contaminated waste water containing hydrocarbons from e.g., oil-separation processes, and the like; aromatic and aliphatic alcohols containing 1–10 carbon atoms, such as methanol, ethanol, propanol, butanol, phenol, and the like; pine oil; petroleum liquids such as, e.g., number 2 fuel oil, number 4 fuel oil, number 6 fuel oil, gasoline, naphtha, and the like; hydrocarbon solvents such as, e.g., benzene, toluene, xylene, kerosene, and derivatives thereof; acetone; aniline; anisole; halobenzenes such as; e.g., bromobenzene and chlorobenzene; nitrobenzene; carbon tetrachloride; chloroform; cyclohexane; n-decane; dodecane; 1,1,2,2-tetrachloroethane; ethyl bromide; 1,2-dichloroethylene; tetrachloroethylene; trichloroethylene; ethylene chloride; ethyl ether; ethyl iodide; glycol; n-hendecane; n-heptane; 1-heptanol; 1-hexanol; methylene halides such as, e.g., methylene chloride, methylene bromide, and methylene iodide; n-octadecane; n-octane; 1-octanol; n-pentadecane pentanol; and the like. The aforementioned list is merely illustrative, and those skilled in the art will recognize that many other liquids can be used in the slurry of this invention.

In one preferred embodiment, the liquid used is carrier water. As used in this specification, the term "carrier water" means the bulk of free water dispersed between the coal particles and contiguous to the bound layers on the particles, and it is to be distinguished from bound water. The term "bound water" means water retained in the "bound water layer", as defined and illustrated in Kirk-Othmer, Encyclopedia of Chemical Technology, 2d Edition, Vol. 22, pages 90–97 (at p. 91).

The kind of water used as carrier water may be any available water, such as mine, well, river, or lake water or desalinated ocean water having a sufficiently low mineral salt content such that the electrochemistry of the bound water layer and carrier water interface can be controlled in accordance with the invention and corrosion of milling facilities, pipe lines and furnaces will be minimized and controllable.

When water is added to a carbonaceous powder comprised of finely divided particles, and if the water "wets" the powder, a surface water film is adsorbed on each particle which is known to be structurally different from the surrounding "free" or bulk water, in that the film may be described as "semi-rigid", or "bound water film". Depending on the fundamental electrical potential of the surface, this "semi-rigid" or bound water film may be of several molecules thickness.

Mixtures of two or more liquids can be used. Thus, by way of illustration and not limitation, one may use mixtures of water and ethanol, water and oil, water and gasoline, and the like. One can use mixtures comprised of from about 1 to about 99 volume percent of alcohol and from about 99 to about 1 volume percent of water. In one preferred embodiment, the mixture is comprised of from about 1 to about 15 volume percent of alcohol with the remainder of the liquid consisting essentially of water. It is preferred that the alcohol be liquid and monohydric and that it contain from about 1 to about 10 carbon atoms. Suitable monohydric alcohols are listed on page 265 of Fieser and Fieser's "Advanced Organic Chemistry" (Reinhold, N.Y., 1961), the disclosure of which is hereby incorporated by reference into this specification. In another preferred embodiment, at least 90 weight percent of the carrier liquid used in the slurry is water and less than 10 weight percent of the carrier liquid is petroleum liquid. In this aspect, it is preferred that the petroleum liquid be selected from the group consisting of naphtha, high gas oil, low gas oil, catalytic cracked recycle oil, mixtures thereof, and other similar petroleum products. Vegetable oils, such as corn, bean, or pine oil, may also be used to replace part or all of the petroleum liquid.

In the process of this invention, the grinding mixture is ground for a time sufficient to produce a carbonaceous slurry which:

1. comprises at least about 5 weight percent (by weight of said dry carbonaceous solid material) of colloidal particles of carbonaceous material which are smaller than about 3 microns;

2. comprises from about 60 to about 82 volume percent of dry carbonaceous solid material and from about 18 to about 40 volume percent of carrier liquid;

3. has a Brookfield viscosity of less than 5,000 centipoise when the slurry is tested at a solids content of 60 volume percent, a shear rate of 100 revolutions per minute, and under ambient temperature and pressure conditions;

4. has a yield stress of from about 3 to about 18 Pascals;

5. contains a consist of finely-divided carbonaceous particles dispersed in said slurry, wherein said consist has a specific surface area of from about 0.8 to about 4.0 square meters per cubic centimeter and an interstitial porosity of less than 20 volume percent, and wherein said consist has a particle size distribution substantially in accordance with the following formula:

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

where $\sum_{j=1}^{k} X_j = 1.0$ and where if $D < D_{sj}$ $\left( \frac{D^{Nj} - D_{sj}^{Nj}}{D_{Lj}^{Nj} - D_{sj}^{Nj}} \right) = 0.0$ and where if $D > D_{Lj}$ $\left( \frac{D^{Nj} - D_{sj}^{Nj}}{D_{Lj}^{Nj} - D_{sj}^{Nj}} \right) = 1.0$ wherein:

(a) CPFT is the cumulative percent of said solid carbonaceous material finer than a certain specified particle size D, in volume percent;

(b) k is the number of component distributions in the consist and is at least 1;

(c) $X_j$ is the fractional amount of the component j in the consist, is less than or equal to 1.0, and the sum of all of the $X_j$'s in the consist is 1.0;

(d) n is the distribution modulus of fraction j and is greater than about 0.001;

(e) D is the diameter of any particle in the consist and ranges from about 0.05 to about 1180 microns;

(f) $D_s$ is the diameter of the smallest particle in fraction j, as measured at 1% CPFT on a plot of CPFT versus size D, is less than $D_L$, and is greater than 0.05 microns;

(g) $D_L$ is the diameter of the size modulus in fraction j, measured by sieve size or its equivalent, and is from about 15 to about 1180 microns.

In the process of this invention, the grinding mixture is ground until a carbonaceous slurry is produced which is comprised of at least about 5 weight percent of colloidal particles. As used herein, the term "colloid" refers to a substance of which at least one component is subdivided physically in such a way that one or more of its dimensions lies in the range of 100 angstroms and 3 microns. As is known, these are not fixed limits and, occasionally, systems containing larger particles are classified as colloids. See *Encyclopedia of Chemistry*, 2d Edition, Clark et al (Reinhold, 1966), page 203, the disclosure of which is hereby incorporated herein by reference.

It is preferred that, in the slurry consist produced by the process of this invention, at least 5 weight percent of the carbonaceous particles are smaller than about 3 microns. It is preferred that from about 5 to about 70 weight percent of the coal particles in said consist be smaller than 3 microns. In one preferred embodiment, from about 5 to about 30 weight percent of the carbonaceous particles in said consist are smaller than 3 microns. In another preferred embodiment, from about 7 to about 20 weight percent of the carbonaceous particles in said consist are smaller than 3 microns.

The carbonaceous slurry produced by the process of this invention contains from about 60 to about 82 volume percent of at least one carbonaceous solid material and from about 18 to about 40 volume percent of carrier liquid. It is preferred that said slurry contain from about 63 to about 80 volume percent of at least one carbonaceous solid material and from about 20 to about 37 volume percent of at least one carrier liquid. In an even more preferred embodiment, the slurry contains from about 65 to about 76 volume percent of at least one carbonaceous solid material and from about 24 to about 35 volume percent of at least one carrier liquid.

The slurry produced by the process of this invention has a relatively low viscosity even though it has a high solids content. The Brookfield viscosity of the slurry is tested after the solids concentration of the slurry is adjusted to a solids content of 60 volume percent (the slurry is either diluted or concentrated until it has this concentration of solids), ambient temperature, ambient pressure, and a shear rate of 100 revolutions per minute. Under these test conditions, the viscosity of the slurry is less than about 5,000 centipoise. It is preferred that the viscosity of the slurry be less than about 4,000 centipoise. It is more preferred that the viscosity of the slurry be less than about 3,000 centipoise. In an even more preferred embodiment, the viscosity of the slurry is less than about 2,000 centipoise. In the most preferred embodiment, the viscosity of the slurry is less than about 1,000 centipoise.

As used in this specification, the term "Brookfield viscosity" describes viscosity as measured by conventional techniques by means of a Brookfield Synchro-Lectric Viscosimeter (manufactured by the Brookfield Engineering Laboratories, Stoughton, Mass., U.S.A.).

The slurry produced by the process of this invention has a yield stress of from about 3 to about 18 Pascals. It is preferred that the yield stress be from about 5 to about 15 Pascals, and it is more preferred that the yield stress be from about 7 to about 12 Pascals. As is known to those skilled in the art, the yield stress is the stress which must be exceeded before flow starts. A shear stress versus shear rate diagram for a yield pseudoplastic or a Bingham plastic fluid usually shows a non-linear hump in the rheogram at the onset of flow; extrapolating the relatively linear portion of the curve back to the intercept of the shear stress axis gives the yield stress. See, for example, W. L. Wilkinson's "Non-Newtonian Fluids, Fluid Mechanics, Mixing and Heat Transfer" (Pergamon Press, New York 1960), pages 1–9, the disclosure of which is hereby incorporated herein by reference. Also see Richard W. Hanks, et al "Slurry Pipeline Hydraulics and Design" (Pipeline Systems Incorporated, Orinda, Calif., 1980), pages II-1 to II-10, the disclosure of which is also hereby incorporated herein by reference.

The slurry produced by the process of this invention contains a consist of finely-divided carbonaceous particles dispersed in the slurry. Said consist has a specific surface area of from about 0.8 to about 4.0 square meters per cubic centimeter. It is preferred that said specific surface area be from about 0.8 to about 3.0 $m^2/cc$. It is more preferred that the specific surface area be from about 0.8 to about 2.4 $m^2/cc$. In an even more preferred embodiment, the specific surface area is from about 0.8 to about 2.0 $m^2/cc$.

As used in this specification, the term "specific surface area" refers to the summation of the surface area of equivalent spheres in the particle size distribution as measured by sieve analysis and sedimentation techniques; the particle size distribution of the consist in the slurry is first determined, it is assumed that all particles in the consist are spherical, and then one calculates the surface area based on this assumption. As used herein, the term "consist" refers to the particle size distribution of the solid phase of the solids-liquid slurry.

For any given consist, one can determine the particle size distribution by means well known to those skilled in the art. For measuring particle sizes and for determining particle size distributions of pulverized and fine grind coal particles used for preparing a coal-water slurry, the following two means of measuring particle sizes can be used and are preferred:

1. U.S. Series sieves Nos. 16, 20, 30, 40, 50, 70, 100, 140, 200, 270, is used to determine weights of coal particles passing through each sieve in the range of about (−) 1180 um to (−) 53 um. The cumulative volume percents of coal particles, dry basis, finer than (CPFT) a particular stated sieve size in microns is charted against the sizes in microns on a log-log chart, referred to herein as a "CPFT chart", to indicate the nature of the particle size distribution of 16 mesh×270 mesh particles.

2. A Sedigraph 5500L (made by Micromeritics, Co., Norcross, Ga., U.S.) is used to measure particle sizes and numbers of particles in coal and in the coal-water slurry in the range of (−) 75 m to about 0.2 mm. The Sedigraph 5500L uses photo-extinction of settling particles dispersed in water according to Stoke's law as a means for making the above determinations. Other instruments, such as a Coulter Counter or combinations of the Leeds & Northrup Microtrac Particle Analyzers can also be used for similar accuracy. The results can be plotted on a CPFT chart. Although these data do not necessarily extend to the size axis at 1% CPFT, the "$D_s$ at 1%" can be determined by extrapolating the CPFT chart line to this axis and reading the intercept. This number, although not the true $D_s$ can be effectively used in the computer algorithm to determine % porosity and specific surface area.

In addition to the above methods, particle size measurements can be estimated from methylene blue index measurements to obtain an approximate determination of the wgt. % of colloidal particles of size below 1 mm. Such a procedure is described in A.S.T.M. Standard C837-76. This index can be compared with the surface area calculated by the CPFT algorithm.

Once the particle size distribution of the consist is determined, it is assumed that each particle in the consist is spherical with a surface area of $\pi D^2$; the diameter D of the particles in each class of particles in the consist is known; and the surface area of the particles in each class is calculated and summed.

The consist of the slurry produced by the process of this invention has an interstitial porosity of less than about 20 percent. It is preferred that said interstitial porosity is less than about 15 volume percent, and it is more preferred that said interstitial porosity be less than about 10 percent. The interstitial porosity is a function of the volume between the interstices of the particles in the slurry consist. For any given space full of particles, the interstitial porosity is equal to the "minimum theoretical porosity" in accordance with the equation presented below.

$$\text{Minimum Theoretical Porosity} = 40\% \ (1 - [1/VA])$$

where VA is as defined by the following modified Westman-Hugill algorithm:

$$VA_1 = A_1X_1$$

$$VA_2 = X_1 + A_2X_2$$

$$VA_3 = X_1 + X_2 + A_3X_3$$

$$\vdots$$

$$VA_i = \sum_{j=1}^{i-1} X_j + A_iX_i$$

$$\vdots$$

$$VA_n = \sum_{j=1}^{n-1} X_j + A_nX_n$$

wherein:

$A_i$=Apparent volume of a monodispersion of the $i^{th}$ size particle, $X_i$=Mass fraction of the $i^{th}$ size particles, $VA_i$=Apparent volume calculated with reference to the $i^{th}$ size particles, n=Number of particle sizes, and VA=Maximum value of $VA_i$=Apparent volume of the mixture of n particle sizes.

To determine the interstitial porosity of any consist, the particle size distribution of said consist can be determined by the method described above with reference to the measurement of the specific surface area. Thereafter, it is assumed that each particle in the consist is spherical, the volume of the particles is calculated in accordance with this assumption, and the interstitial porosity of the consist is then calculated in accordance with the above formula. It is noted that this calculated porosity is less than the true porosity of a consist as measured, for example, by liquid loss—due to the non-spherical morphology (shape) of the particles, and by invocation of $D_s$ at 1%.

The slurry produced by the process of this invention comprises a compact of finely-divided carbonaceous particles dispersed in fluid such as, e.g., finely-divided coal particles dispersed in water. The term compact, as used in this specification, refers to a mass of finely-divided particles which are closely packed in accordance with this invention.

The particles in the compact of said slurry have a specified particle size distribution which is substantially in accordance with the following formulae:

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

$$\text{where } \sum_{j=1}^{k} X_j = 1.0$$

$$\text{and where if } D < D_{sj} \left( \frac{D^{Nj} - D_{sj}^{Nj}}{D_{Lj}^{Nj} - D_{sj}^{Nj}} \right) = 0.0$$

$$\text{and where if } D > D_{Lj} \left( \frac{D^{Nj} - D_{sj}^{Nj}}{D_{Lj}^{Nj} - D_{sj}^{Nj}} \right) = 1.0$$

wherein CPFT is the cumulative percent of the carbonaceous solid finer than a certain specified particle size D, in volume percent; k is the number of component distributions in the consist, is at least 1, and preferably is from about 1 to about 30; $X_j$ is the fractional amount of the component j in the consist, is less than or equal to 1.0, and the sum of all $X_j$'s in the consist is 1.0; n is the distribution modulus (or slope) of fraction j, is greater than about 0.001, preferably is from about 0.001 to about 10.0 and more preferably from 0.01 to about 1.0, and most preferably is from about 0.01 to about 0.5; D is the diameter of any particle in the consist and ranges from about 0.05 to about 1180 microns; $D_s$ is the diameter of the smallest particle in fraction j (as measured by extrapolating the CPFT chart line, if necessary, to one percent CPFT using data from sieve analyses plus the Micromeritics Sedigraph 5500L) and is generally greater than 0.05 microns but is less than $D_L$, $D_L$ represents the diameter of the largest particle in fraction j (sieve size or its equivalent), it ranges from about 15 to about 1180 microns, preferably is from about 30 to about 420 microns, and most preferably is from about 100 to about 300 microns; $D_L$ is the theoretical size modulus of the particle size distribution; when CPFT is plotted against size, the $D_L$ value is indicated as the intercept on the upper X axis of the CPFT/D plot. However, as is known to those skilled in the art, because of aberrations in grinding the coarse end of a particle size distribution, the actual top particle size is always larger than the $D_L$ obtained by, e.g., the particle size equation described in this case; thus, e.g., a $D_L$ size modulus of 250 microns will usually produce a particle distribution with at least about 98 percent of the particles smaller than 300 microns. Consequently, said slurry has a compact with a particle size distribution which is substantially in accordance with the CPFT equation; minor deviations caused by the actual top size being greater than the $D_L$ are within the scope and spirit of this invention.

When k is 1, the aforementioned equation simplifies to:

$$\frac{CPFT}{100} = \frac{D^n - D_s^n}{D_L^n - D_s^n}$$

when k is 2, the equation becomes:

$$\frac{CPFT}{100} = X_1\left(\frac{D^{N1} - D_{s1}^{N1}}{D_{L1}^{N1} - D_{s1}^{N1}}\right) + X_2\left(\frac{D^{NL} - D_{s2}^{N2}}{D_{L2}^{N2} - D_{s2}^{N2}}\right)$$

I II wherein: $X_1+X_2-1.0$ (i.e., the sum of the fractional parts is equal to the whole); when D is less than or equal to $D_{s1}$, the first term in the parentheses (term I) is equal to 0.0; when D is greater than or equal to $D_{L1}$, the first term in the parentheses (term I) is equal to 1.0; when D is less than $D_{S2}$, the second term in the parentheses (term II) is equal to 0.0; when D is greater than $D_{L2}$, the second term in the parentheses (term II) is equal to 1.0.

The reason for the aforementioned constraints of the terms in parentheses I and II is that each of these terms refers to the equation of one of the two components.

In order to sum the fractional parts of the two component distributions, the above considerations must be included since particles of a certain size may be represented between the effective $D_S$ and $D_L$ of the total distribution but not between the $D_S$ or $D_L$ of one of the component distributions. Thus, the values in parentheses I and II are subject to the limitations that, when D is less than or equal to $D_S$, the value for the term is 0.0 and when D is greater than $D_{Lj}$, the value of the term is 1.0.

The equation given above for when k is 2 is simply the sum of two components where the fraction of component $j_1$ or $X_1$ and the fraction of component $j_2$ is $X_2$. Since, in this case, $X_1$ and $X_2$ make up the whole distribution, their sum must equal 1.0.

In accordance with the above reasoning, when k=3, the equation becomes:

$$\frac{CPFT}{100} = X_1\left(\frac{D^{N1} - D_{s1}^{N1}}{D_{L1}^{N1} - D_{s1}^{N1}}\right) + X_2\left(\frac{D^{N2} - D_{s2}^{N2}}{D_{L2}^{N2} - D_{s2}^{N2}}\right) + X_3\left(\frac{D^{N3} - D_{s3}^{N3}}{D_{L3}^{N3} - D_{s3}^{N3}}\right)$$

when k=4, there is a fourth term in the equation equal to $$X_4\left(\frac{D^{N4} - D_{s4}^{N4}}{D_{L4}^{N4} - D_{s4}^{N4}}\right)$$

In one preferred embodiment, k=1. In this embodiment:

$$\frac{CPFT}{100} = \frac{D^n - D_s^n}{D_L^n - D_s^n}$$

$D_s$ represents the diameter of the smallest particle in the consist (as measured by the CPFT chart line extrapolated if necessary to 1% CPFT using data from sieve analysis plus the Micromeritics Sedigraph 5500L), being from about 0.05 to about 0.4 microns, more preferably from about 0.05 to about 0.25 microns, and most preferably from about 0.05 to about 0.20 microns. $D_L$ is the diameter of the largest particle in the compact, sieve size or its equivalent; $D_L$ ranges from about 15 to about 1180 microns, preferably is from about 30 to about 420 microns, and most preferably is from about 100 to about 300 microns; $D_L$ is the theoretical size modulus of the particle size distribution as determined in equation (1).

In one embodiment of the slurry produced by the process of this invention, no more than 0.5 weight percent of the solid carbonaceous particles in the slurry have a particle size less than 0.05 microns.

It is preferred that at least 85 weight percent of the carbonaceous particles in the slurry have a particle size less than 300 microns. It is more preferred that at least 90 weight percent of the carbonaceous particles in the slurry have a particle size less than 300 microns. In the most preferred embodiment, at least 95 weight percent of the carbonaceous particles in the slurry have a particle size less than 300 microns.

In one preferred embodiment, in the slurry produced by the process of this invention, the fluid is water and colloidal sized carbonaceous particles in the slurry have a net zeta potential of from about 15 to about 85 millivolts. The following discussion of zeta potential will refer to a coal-water slurry, it being understood that the discussion is equally applicable to, e.g., coke-water slurries, graphite-water slurries, etc.

It is preferred that the colloidal sized particles coal in the coal-water slurry have a net zeta potential of of from about 15 to about 85 millivolts. As used herein, the term "zeta potential" refers to the net potential, be it positive or negative in charge; thus, a zeta potential of from about 15.4 to 70.2 millivolts includes zeta potentials of from about −15.4 to about −70.2 millivolts as well as zeta potentials of from about +15.4 to about +70.2 millivolts. In a more preferred embodiment, said zeta potential is from about 30 to 70 millivolts.

As used in this specification, the term "zeta potential" has the meaning given it in the field of colloid chemistry. Concise discussions and descriptions of the zeta potential and methods for its measurement are found in many sources including, T. M. Riddick, U.S. Pat. No. 3,454,487, issued July, 1969; Douglas et al., U.S. Pat. No. 3,976,582 issued Aug. 24, 1976; *Encyclopedia of Chemistry,* 2nd edition, Clark et al., Reinhold Publ. Corp. 1966, pages 263–265; *Chemical and Process Technology Encyclopedia,* D. M. Considine, editor-in-chief, McGraw-Hill Book Company, N.Y., pages 308–309; *Chemical Technology: An Encyclopedic Treatment,* supra, Vol. VII, pages 27–32; Kirk-Othmer, *Encyclopedia of Chemical Technology,* 2nd Edition, Vol. 22, pages 90–97; and T. M. Riddick, *Control of Colloid Stability Through Zeta Potential,* Zeta-Meter, Inc. New York City. The disclosures of the aforementioned documents are hereby incorporated into this specification by reference. "Zeta potential" may be measured by conventional techniques and apparatus of electroosmosis such as those described, e.g., in Potter, "Electro Chemistry"; Cleaver-Hume Press, Ltd.; London (1961). Zeta potential can also be determined by measuring electrophoretic mobility (EPM) in any of several commercial apparatus. In the present invention, a Pen Kem System 3000 (made by Pen Kem Co. Inc. of Bedford Hills, N.Y.) was used for determining zeta potential in the examples herein. This instrument is capable of automatically taking samples of coal particles and producing an EPM distribution by Fast Fourier Transform Analysis from which the average zeta potential can be calculated in millivolts.

The zeta potential is measured using very dilute samples of the $<10$ μm sized coal particles in the coal compact of the coal-water slurry.

It is preferred that the zeta potential of the colloidal sized coal particles in the coal consist of the slurry of this invention be negative in charge and be from about −15.4 to about −70.2 millivolts. It is more preferred that said zeta potential be from about −30 to about −70 millivolts.

In one embodiment, it is preferred that the zeta potential of said colloidally sized coal particles be "near maximum". "Near maximum zeta potential", as used in this specification, means a value of zeta potential, measured at constant electrical conductivity, below the maximum zeta potential as defined and discussed in the reference cited in the portion of this specification wherein the term "zeta potential" is defined. It is sometimes necessary to normalize the zeta potential values with respect to the electrical conductivity of the carrier fluid because zeta potential is limited by the electrical conductivity of the carrier fluid. The near maximum zeta potential should be of a millivoltage sufficient to provide the coal particles with a repulsive charge great enough to disperse the coal particles in the coal-water slurry. In this embodiment, it is preferred that the zeta potential on the colloidal coal particles be from about 20 to about 95 percent of the maximum zeta potential. It is more preferred that the zeta potential on the colloidal coal particles be from about 40 to about 80 percent of the maximum zeta potential for this embodiment.

The maximum zeta potential may be determined by measuring the Brookfield viscosity of the slurry at different zeta potentials. For a given system, maximum zeta potential has been reached when further increase in the surfactant concentration in the slurry do not further decrease the Brookfield viscosity of the system at 100 rpm.

One preferred means for measuring the zeta potential is to grind a sample of coal in either a laboratory size porcelain ball mill with porcelain balls in distilled water at 30 weight percent solids for approximately 24 hours or in a steel ball mill with steel balls at 30 weight percent solids for 16 hours or until all of the particles in the coal are less than 10 microns in size. Small samples of this larger sample can then be prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agent organic surfactants likewise are added in incremental amounts (e.g., grams per gram coal, both dry basis), alone or in combinations of two or more. These samples are then evaluated in any electrophoretic mobility, electroosmosis, or streaming potential apparatus to determine electrical data, from which the zeta potential is calculated in a known way. Plots of zeta potential, pH, and specific conductance vs concentration may then be made to indicate candidate surfactants, or combinations thereof to be used to produce the optimum dispersion of coal particles in the carrier water below the amount at which dilatency may be reached.

In one preferred embodiment, the slurry produced by the process of this invention has a specified interrelationship between the concentration of solid carbonaceous material in said slurry, the interstitial porosity of the slurry consist, the specific surface area of said consist, and the zeta potential of said colloidal sized particles of solid carbonaceous material to the consists. Said factors are interrelated in accordance with the following formula:

$$V_s + P_s + SA + \frac{240}{ZP} = H$$

wherein:

$V_s$ is the porosity of the carbonaceous consist of the slurry, in percent;

P is the percent of the carbonaceous solids in the slurry, in volume percent;

SA is the specific surface area of the consist of the slurry, in square meters per cubic centimeter;

ZP is the net zeta potential of the colloidal sized particles in the consist of the slurry, in millivolts; and H is a coefficient varying from 75–98.

During the time that the grinding mixture used in the process of this invention is being ground to produce said slurry, from about 10 to about 90 weight percent of the optimum amount of dispersing agent is added to the grinding mixture by adding at least two separate portions of dispersing agent to the grinding mixture at at least two separate times. It is preferred to add from about 20 to about 80 weight percent of the optimum amount of dispersing agent to the grinding mixture during the time it is being ground. It is more preferred to add from about 30 to about 70 weight percent of the optimum amount of the dispersing agent to the grinding mixture while it is being ground. In an even more preferred embodiment, from about 40 to about 60 weight percent of the optimum amount of dispersing agent is added to the grinding mixture while it is being ground. In the most preferred embodiment, from about 45 to about 55 weight percent of the optimum amount of dispersing agent is added to the grinding mixture while it is being ground. The optimum amount of dispersant is determined by the test specified in this specification.

It is preferred to add at least three separate portions of dispersing agent to the grinding mixture at at least three separate times. It is more preferred to add at least four separate portions of dispersing agent to the grinding mixture at at least four separate times. In one embodiment, it is most preferred to add at least five separate portions of dispersing agent to the grinding mixture at at least five separate times. Regardless of how many separate portions of dispersing agent are added to the grinding mixture, the total amount of dispersing agent added never exceeds about 90 weight percent of the optimum amount of dispersing agent.

The term "optimum amount of dispersing agent", as used in this specification refers to the dispersing agent concentration as determined by the test mentioned below. Any given mixture of carbonaceous material(s) and liquids(s) will have a specified solids content, n, $D_L$, and $D_s$. The "optimum concentration of dispersing agent(s) must be separately determined for each given mixture of carabonaceous material and liquid, for it will vary from mixture to mixture. Similarly, for a given mixture, the "optimum concentration of dispersing agent" must be separately determined for each dispersing agent or combination of dispersing agents, for it may vary for a given system with different dispersing agent systems.

For a given dispersing agent system and a given mixture of carbonaceous material(s) and liquid(s), different concentrations of the dispersing agent system are added prior to the time the mixture is ground, the mixture is then ground until at least about 98.5 weight percent of the carbonaceous material in the mixture passes through a 50 mesh screen, and the viscosity of the mixture is then determined. That concentration of dispersing agent which, for a given mixture and dispersing agent, yields the lowest viscosity after the mixture is ground to a particle size 98.5% less than 50 mesh, is "optimum" for that dispersing agent and that mixture.

FIG. 1 illustrates one means of evaluating the effectiveness of surfactants for any given solid material. The curves of FIG. 1 represent data obtained using both a purported nonionic polymer CW-11 made by the Diamond Shamrock Process Chemicals Co. and anionic lignosulfonate Polyfon-F made by Westvaco, Inc., absorbed on an Australian coal. The fine coal ground to about 100% finer than 10 microns is slurried in distilled water at 0.01 weight percent solids. Aliquots are placed in test tubes and increasing amounts of any candidate surfactant is added to each test tube. The test tube samples are thoroughly mixed and inserted into a sampler carousel. The Pen Kem System 3000 Electrophoretic Mobility Analyzer automatically and sequentially samples each test tube and measures the electrophoretic mobility of the coal particles and the specific conductance of the carrier liquid. pH can also be measured on each sample. In FIG. 1 the left ordinate gives the calculated zeta potential of the particles in millivolts, the right ordinate gives the specific conductance in micromhos of the carrier liquid. These variables are both measured as a function of the percent addition of each surfactant on a dry coal basis which is plotted on the abscissa. FIG. 1 shows that the purported nonionic CW-11 surfactant does have some anionic character. CW-11 has a zeta potential of −50 mv at 300% addition on 0.01% dry coal. Polyfon-F has a zeta potential of −55 mv at 200% addition on 0.01% dry coal. Furthermore the specific conductance of the Polyfon-F at −55 mv zeta potential is greater than CW-11 at −50 mv. These data estabish Polyfon-F as a more chemically effective surfactant for use on this particular Australian coal.

In one of the preferred embodiments of the process of this invention, the total amount of dispersing agent added up to any one point in the grinding cycle is related to the specific surface area of the slurry consist which exists at that point. In this preferred embodiment, the optimum concentration of dispersing agent(s) is determined for a particular system in accordance with the procedure described above. The optimum concentration of dispersing agent(s) is added in one step, to the carbonaceous material-liquid slurry system, the system is then ground until 98.5 weight percent of its carbonaceous are smaller than 50 mesh (300 microns), and during the grinding samples are periodically withdrawn from the system and analyzed for specific surface area. The ratio of the surface area generated at any one point in the grinding cycle to the final surface area (when the final slurry product, which contains at least about 98.5 weight percent of carbonaceous particles smaller than 300 microns, is obtained) must be 1.0 or less. In this preferred embodiment, the total amount of surfactant added up to any one point in time does not exceed the surface area ratio at that point in time times the optimum dispersant concentration times a factor of from about 0.1 to about 0.9. Thus, by way of illustration, if the optimum dispersing agent concentration for a particular coal-water system is 0.7 weight percent of dispersing agent and if, at 60 minutes into the grinding cycle, the specific surface area of the slurry consist is 0.5 times as much as the final specific surface area which will be obtained when the grinding is completed, then only enough additional dispersant can be added so that, at time 60 minutes, the total amount of surfactant is the system does not exceed:

(0.7 weight percent dispersing agent)×(0.5)×(0.1 to 0.9)=from 0.035 weight percent of dispersing agent to about 0.315 weight percent of dispersing agent. Lesser amounts than 0.315 weight percent of dispersant can be used for this system, but greater amounts should not be used.

It is preferred that the dispersing agent used in the process of this invention be an organic compound which encompasses in the same molecule two dissimilar structural groups, e.g., a water soluble moiety, and a water insoluble moiety. It is preferred that said dispersing agent be a surfactant. The term "surface-active agent", or "surfactant", as used in the prior art indicates any substance that alters energy relationships at interface, and, in particular, a synthetic or natural organic compound displaying surface activity including wetting agents, detergents, penetrants, spreaders, dispersing agents, foaming agents, etc.

The surfactant used in the process of this invention is preferably an organic surfactant selected from the group consisting of anionic surfactants, cationic surfactants, and amphoteric surfactants. It is preferred that the surfactant be either anionic or cationic. In the most preferred embodiment, the surfactant is anionic.

It is preferred that the molecular weight of the surfactant used in the process of this invention be at least about 200. As used herein, the term "molecular weight" refers to the sum of the atomic weights of all the atoms in a molecule.

In one preferred embodiment, the surfactant is anionic and its solubilizing group(s) is selected from the group consisting of a carboxylate group, a sulfonate group, a sulfate group, a phosphate group, and mixtures thereof. By way of illustration, one of these preferred anionic surfactants is a polyacrylate having the general formula:

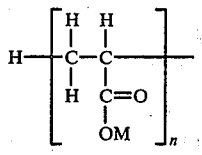

wherein n is a whole number of at least 3 and M is selected from the group consisting of hydrogen, sodium, potassium, and ammonium.

In another preferred embodiment, the surfactant is cationic and its solubilizing group(s) is selected from the group consisting of a primary amine group, a secondary amine group, a tertiary amine group, a quarternary ammonium group and mixtures thereof.

In yet another embodiment, the surfactant is amphoteric. In this embodiment, the surfactant has at least one solubilizing group selected from the group consisting of a carboxylate group, a sulfonate group, a sulfate group, a phosphate group, and mixtures thereof; and the surfactant also has at least one solubilizing group selected from the group consisting of a primary amine group, a secondary amine group, a tertiary amine group, a quaternary ammonium group, and mixtures thereof.

In one of the more preferred embodiments, the surfactant used in the process of this invention is comprised of at least about 85 weight percent of a structural unit of the formula:

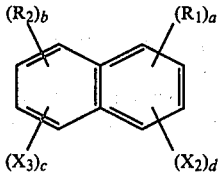

wherein $R_1$ and $R_2$ are independently selected from the group consisting of alkyl of from about 1 to about 6 carbon atoms and hydrogen; a, b, c, and d are integers independently selected from the group consisting of 0, 1, 2, 3, 4, 5, 6, 7, and 8, and $X_2$ and $X_3$ are independently selected from the group consisting of a carboxylate group, a sulfonate group, a sulfate group, a phosphate group, a nitro group, a halo group selected from the group consisting of chloro, bromo, fluoro, and iodo, —CN, an alkoxy group containing from 1 to about 6 carbon atoms, and a group of the formula $—R_3OR_4$ wherein $R_3$ and $R_4$ are an alkyl containing from about 1 to about 3 carbon atoms. The starting materials which can be used to prepare these surfactants are well known to those skilled in the art and include, e.g., naphthalene-αsulfonic acid (dihydrate), naphthaleneβ-sulfonic acid (monohydrate), α-nitronaphthalene, β-nitronaphthalene, α-naphthylamine, β-naphthylamine, α-naphthol, β-naphthol, α-naphthoic acid, β-naphthoic acid, α-chloronaphthalene, α-bromonaphthalene, β-bromonaphthalene, β-chloronaphthalene, α-naphthonitrole, β-naphthonitrile, 1,5-dinitronaphthalene, 1,8-dinitronaphthalene, β-methylnaphthalene, 1-nitro-2-methylnaphthalene, 2-methylnapthalene-6-sulfonic acid, 2,6-dimethylnaphthalene, β-6-methylnaphtholpropionic acid, 1,6-dibromo-2-naphthol, 6-bromo-2-naphthol, 1,6-dibromonaphthalene, 6-bromo-2-naphthol, and the like. Again, it is preferred that at least one of the atoms in this surfactant be an alkali metal selected from the group consisting of sodium, potassium, ammonium, and mixtures thereof, One of the most preferred surfactants from this group is the alkali metal salt of a condensed mono maphthalene sulfonic acid. This acid, whose preparation is described in U.S. Pat. No. 3,067,243 (the disclosure of which is hereby incorporated by reference into this specification), can be prepared by sulfonating naphthalene with sulfuric acid, condensing the sulfonated naphthalene with formaldehyde, and then neutralizing the condenstate so obtained with sodium hydroxide. This alkali or $NH_4^+$ metal salt of a condensed mono naphthalene sulfonic acid is comprised of at least about 85 weight percent of a repeating structural unit of the formula

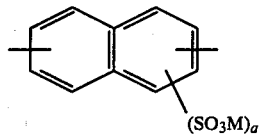

wherein M is an alkali metal selected from the group consisting of sodium, potassium, and ammonium and a is an integer of from 1 to 8. Comparable compounds with a benzene rather than napthalene nucleus also can be used.

Examples of anionic organic surfactants which have been found particularly advantageous for providing yield pseudoplastic rheological properties to coal-water slurries, particularly those containing about 65 to 85 weight % of West Virginia or Black Mesa, Arizona coal, are shown below. In some cases, mixtures of two or more of these surfactants beneficially can be used.

| Anionic Organic Surfactant | Tradename | Form | % Conc. |
|---|---|---|---|
| 2-ethylhexyl polyphosphoric ester acid anhydride | Strodex MO-100 | Liquid | 100 |
| Potassium Salt of MO-100 | Strodex MOK-70 | Paste | 70 |
| Complex organic polyphosphoric ester acid anhydride | Strodex MR-100 | Liquid | 100 |
| Complex organic polyphosphoric ester acid anhydride | Strodex SE-100 | Liquid | 100 |
| Complex orgainic polyphosphoric ester acird anhydride | Strodex P-100 | Liquid | 100 |
| Complex orgainic polyphosphoric ester acid anhydride | Strodex PK-90 | Liquid | 90 |
| Potassium salt of complex organic polyacid anhydride | Strodex MRK-98 | Liquid | 98 |

-continued

| Anionic Organic Surfactant | Tradename | Form | % Conc. |
|---|---|---|---|
| Potassium salt of complex organic polyacid anhydride | Strodex SEK-50 | Liquid | 50 |
| Potassium salt of complex organic polyacid anhydride | Strodex PSK-58 | Liquid | 58 |
| Potassium salt of complex organic polyacid anhydride | Strodex V-8 | Liquid | 85 |
| Sodium salt of condensed mono naphthalene sulfonic acid | Lomar D Lomar NCO Lomar PW | Powder | 86-90 |
| Sodium salt of condensed mono naphthalene sulfonic acid | Lomar LS | Powder | 95 |
| Ammonia salt of condensed mono naphthalene sulfonic acid | Lomar PWA | Powder | 89 |
| Solution of sodium salt of condensed mono naphthalene sulfonic acid | Lomar PL | Liquid | 45 |
| Sodium salt of a carboxylated polyelectrolyte | Daxad 30 | Liquid | 25 |

Strodex is a trademark of Dexter Chemical Corporation.

Lomar is a trademark of Diamond Shamrock Process Chemicals, Inc.

Daxad is a trademark of W. R. Grace & Co. Organic Chemicals Division.

Some preferred surfactants are selected from the group consisting of:

(i) 2-ethylhexyl polyphosphoric ester acid anhydride and its potassium salt.

(ii) complex organic polyphosphoric ester acid anhydride and its potassium salt.

(iii) condensed mononaphthalene sulfonic acid and its sodium and ammonium salts, and (iv) polymerized substituted phenyl propanes and their salts (lignosulfonates)

(v) copolymers of acrylic acid and ethylene sulfonates (vi) mixtures thereof

While the use of the sodium, potassium or ammonium salts of condensed mononaphthalene sulfonic acid is preferred, it is to be understood that the condensed mononaphthalene sulfonic acid can be used with the addition of sodium, potassium, or ammonium alkali to form the corresponding alkali metal salt of that acid in situ.

One of the more preferred surfactants is "Nopcosperse-VFG", an anionic surfactant which is available from the Diamond Shamrock Process Chemicals Division of Diamond Shamrock Corporation, Morristown, N.J. Another of the more preferred surfactants is of the formula

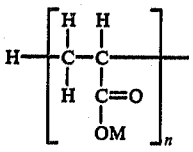

wherein M is alkali metal (and most preferably is sodium) and n is less than 200 and, preferably, less than 100.

Yet another of the preferred embodiments is an anionic, alkylaryl sulfonate which is liquid and has an HLB number of from about 8.0 to 15.0.

Yet another preferred surfactant is a lignin-based dispersing agent which is water soluble and which contains a sulfite lignin which ranges in molecular weight from about 1,000 to about 50,000 and whose basic lignin unit is a substituted phenylpropane. This lignin can be generated by the acid sulfite wood pulping process.

Yet another preferred surfactant is a lignin-based dispersing agent which is water-soluble and which contains an alkali lignin isolated from sulfate pulping black liquor generated in the alkaline sulfate wood pulping process.

Yet another class of preferred surfactant is a complex polymerized organic salt of sulfonic acids of the alkylaryl type such as, e.g., sodium naphthalene sulfonic acid formaldehyde, sodium salts of polymerized alkyl napthelene sulfonic acid, and the like. One preferred species within this class is Darvan No. 1, a dispersing agent sold by the R. T. Vanderbilt Company, Inc. of Norwalk, Conn. which has a pH of from 8.0 to 10.5 (in one percent solution).

Yet another preferred surfactant class is the class of alkali metal (sodium) salts of polymerized benzoid alkyl sulfonic acids. One of the species within this class is Darvan No. 2 (available from said R. T. Vanderbilt Company) which has a pH (in one percent solution) of from about 7.8 to about 10.4.

Another preferred class of surfactants is the lignosulfonates. These lignosulfonates have an equivalent weight of from about 100 to about 350, contain from about 2 to about 60 phenyl propane units (and, preferably, from about 3 to 50 phenyl propane units), and are made up of cross-linked polyaromatic chains. Some of the preferred lignosulfonates include those listed on page 293 of McCutcheon's "Emulsifiers and Detergents), North American Edition (McCutcheon Division, MC Publishing Co., Glen Rock, N.J., 1981) and in the other portions of McCutcheon's which describes said lignosulfonates, the disclosure of which is hereby incorporated by reference into this specification. In one preferred embodiment, the lignosulfonate surfactant contains from about 0.5 to about 8.0 sulfonate groups. In this preferred embodiment, one species has 0.5 sulfonate groups, one has one sulfonate group, one has two sulfonate groups, and one has four sulfonate groups, and one has 7.5 sulfonate groups.

Applicant does not wish to be bound to any particular theory. However, he believes that a dispersing agent in a slurry might perform at least three functions. In the first place, it is believed that a water soluble dispersing agent, which also serves as a wetting agent (such as an organic surfactant), functions to promote the wettability of the coal particles by water. As used herein, the term "wetting" indicates covering or penetrating the coal particle surface with a bound water layer. Such a wetting agent might or might not be needed, depending upon the surface chemistry of the coal, its hydrophobicity, and the associated electrochemistry of its inherent bound water layers. For example, inherent bed moisture and chemical compounds already present in natural coal deposits may allow wetting of the ground coal by added water.

In the second place, a dispersing agent might function to promote deflocculation of coal particles, preferably in the presence of advantageous electrolytes. As used herein, the term "deflocculating" indicates dispersion of particles, preferably of colloidal sized coal particles. Thus, e.g., a "deflocculating agent" includes a dispersing agent which promotes formation of a colloidal dispersion of colloidal sized particles in a solids-liquid slurry. It has been found that the presence of large, monovalent cations—such as $Na^+$, $Li^+$, or $K^+$—tend to promote deflocculation of colloidal sized coal particles in a solids-liquid slurry. However, higher valence cations—such as $Ca^{+2}$, $Al^{+3}$, and $Mg^{+3}$—tend to cause said particles to flocculate under certain conditions. Consequently, an organic anionic surfactant which wets the coal particles and contains a residual $Na^+$ and/or $K^+$ and an $Li^+$ can be a very effective deflocculant for the coal-water slurry of this invention.

In the third place, in some cases the dispersing agent enhances the pumpability of the coal-water slurry. It is believed that this effect occurs because of enhancement or inhibition of the bound, or semi-rigid, water layer because the dispersing agent provides a cation as a counterion for the bound water layer, thereby affecting the yield pseudoplastic index (slope of a plot of log viscosity versus log shear rate) of the mass. Preferably, the cation provided by the dispersing agent is $NH_4^+$, $Na^+$ and/or $K^+$. Consequently, it is preferred to incorporate an advantageous electrolyte, such as an ammonium or alkali metal base, into the coal-water slurry to increase deflocculation of the slurry and thus improve its yield pseudoplasticity. However, it should be noted that the incorporation of an alkaline earth metal base into the slurry is substantially ineffective in promoting deflocculation.

It is preferred that the dispersing agent(s) used in the process of this invention provide one or more ions to the slurry. As used in this specification, the term "ion" includes an electrically charged atom, an electrically charged radical, or an electrically charged molecule.

In one preferred embodiment, the dispersing agent(s) used in the process of this invention provides one or more counterions which are of opposite charge to that of the surface of the coal particles. The charge on the surface of the coal particles in water is generally negative, and thus it is preferred that said counterions have a positive charge. The most preferred positively charged ions are the sodium and potassium cations and the ammonium radical.

In one embodiment it is preferred that the dispersing agent(s) used in the process of this invention be a polyelectrolyte which, preferably, is organic. As used in this specification, the term "polyelectrolyte" indicates a polymer which can be changed into a molecule with a number of electrical charges along its length. It is preferred that the polyelectrolyte have at least one site on each recurring structural unit which, when the polyelectrolyte is in aqueous solution, provides electrical charge; and it is more preferred that the polyelectrolyte have at least two such sites per recurring structural unit. In a preferred embodiment, said sites comprise ionizable groups selected from the group consisting of ionizable carboxylate, sulfonate, sulfate and phosphate groups. Suitable polyelectrolytes include, e.g., the alkali metal and ammonium salts of polycarboxylic acids such as, for instance, polyacrylic acid; the sodium salt of condensed naphthalene sulfonic acid; polyacrylamide; and the like.

In one preferred embodiment, the slurry of the process of this invention contains from about 0.05 to about 4.0 weight percent by weight of dry solids in the slurry, of an electrolyte which, preferably, is inorganic. As used in this specification, the term "electrolyte" refers to a substance that dissociates into two or more ions to some extent in water or other polar solvent. This substance can be, e.g., an acid, base or salt.

In a more preferred embodiment, the slurry of the process of this invention is comprised of from about 0.05 to about 2.0 weight percent of an inorganic electrolyte. In the most preferred embodiment, said coal-water slurry is comprised of from about 0.1 to about 0.8 weight percent of said electrolyte. In the most preferred embodiment, the slurry contains from about 0.1 to about 0.5 percent of inorganic electrolyte.

Any of the inorganic electrolytes known to those skilled in the art can be used in the slurry of the process of this invention. Thus, by way of illustration and not limitation, one can use the ammonia or alkali metal salt of hexametaphosphates, pyrophosphates, sulfates, carbonates, hydroxides, and halides. Alkaline earth metal hydroxides can be used. Other inorganic electrolytes known to those skilled in the art also can be used.

In one preferred embodiment, the inorganic electrolyte is of the formula $$M_aZ_b$$

wherein M is an alkali metal selected from the group consisting of lithium, sodium, potassium, ammonium, rubidium, cesium, and francium, or ammonium, b is the valence of cation M; a is the valence of anion Z; and Z is an anion selected from the group consisting of hexametaphosphate, pyrophosphate, silicate, sulfate, carbonate, hydroxide, and halide anions. It is preferred that Z be selected from the group consisting of carbonate, hydroxide, and silicate anions. The most preferred electrolytes are selected from the group consisting of potassium carbonate, sodium hydroxide, and $Na_2SiO_3\ 9H_2O$.

It is preferred that the slurry of the process of this invention contain both said dispersing agent(s) and said inorganic electrolyte(s) and that from about 0.05 to about 10.0 parts (by weight) of the inorganic electrolyte are present for each part (by weight) of the dispersing agent(s) in the slurry.

It is preferred that the total concentration of both the dispersing agent(s) and/or the inorganic electrolyte be from 0.05 to 4.0 weight percent.

In one preferred embodiment, the slurry of the process of this invention is comprised of dispersing agent(s) and inorganic electrolyte agent(s) which, when dissolved in water provide electrically charged ions to the slurry. The amount of electrically charged ions preferably present in the slurry ranges from about 0.01 to about 2.5 weight percent, based upon weight of dry coal, and most preferably is from about 0.05 to about 2.0 weight percent. Said concentration of electrically charged ions can be calculated by first calculating the weights of the ions in each of the dispersing agent(s) and the electrolyte agent(s), adding said weight(s), and then dividing the total ion weight by the weight of the dry coal.

By way of illustration, in one embodiment 0.75 grams of sodium hydroxide and 0.75 grams of sodium decyl benzene sulfonate were added to a slurry comprised of 100 grams of dry coal. The weight of the sodium ion provided by the caustic was equal to $22/40\times0.75$ grams; and it equals 0.4125 grams. The weight of the sodium ion provided by the sodium decyl benzene sulfonate was equal to $22/294\times0.75$ grams; and it equals 0.0561 grams. The total weight of the sodium ion provided by both the caustic electrolyte and the sulfonate dispersing agent was 0.4686 grams. Thus, the slurry contained 0.468 weight percent of sodium ion.

In the process of this invention, one or more carbonaceous solid materials is mixed with one or more liquids to form a grinding mixture, and thereafter the grinding mixture is mixed with one or more dispersing agents and, optionally, additional carbonaceous material (e.g., fine carbonaceous solid material) and/or additional liquid and/or additional dispersant.

The terms "mixed" and "mixing", as used in this specification, refer to the steps of combining or blending several masses into one mass and includes, e.g., blending, grinding, milling, and all other steps by which two or more masses are brought into contact with each other and combined to some extent. Conventional means for mixing viscous materials can be used in the process of this invention. Thus, by way of illustration and not limitation, one can use batch mixers such as change-can mixers, stationary tank mixers, gate mixers, shear-bar mixers, helical blade mixers, double-arm kneading mixers, screw-discharge batch mixers, intensive mixers, roll mills, bulk blenders, Littleford-Lodige mixers, cone and screw mixers, pan muller mixers, and the like; one can use continuous mixers such as single-screw extruders, the Rietz extrudor, the Baker Perkins Ko-Kneader, the Transfer-Mix, the Baker Perkins Rotofeed, twin-screw continuous mixers, trough and screw mixers, pug mills, the Kneadermaster, and the like; one can use tumbling mills such as, e.g., ball mills, pebble mills, rod mills, tube mills, compartment mills, and the like; and one can use non-rotary ball or bead mills such as stirred mills (including the Sweco dispersion mill, the Attritor, the Bureau of Mines mill described in U.S. Pat. No. 3,075,710, vibratory mills such as the Vibro-Energy mill, the Podmore-Boulton mill, the Vibration, and the like. The various processes and apparatuses which can be used to mix the carbonaceous solid with the carrier liquid and dispersant are well known to those skilled in the art and are described in, e.g., Perry and Chilton's *Chemical Engineers' Handbook*, Fifth Edition (McGraw Hill, New York, 1973), pages 19–14 to 19–26 (Paste and viscous-material mixing), and 8–16 to 8–44 (crushing and grinding equipment). The disclosure of the aforementioned portions of the *Chemical Engineers' Handbook* is hereby incorporated by reference into this specification.

When the liquid mixed with the carbonaceous solid is water or is comprised of from about 5 to about 99 weight percent of water, it is preferred that the temperature of the solids-liquid mixture be maintained at from ambient to about 99 degrees centigrade to insure that the water does not substantially vaporize; thus, if need be, said mixture can be cooled by conventional means during the mixing step.

From about 60 to 82 volume percent of at least one carbonaceous solid is mixed with liquid in the process of this invention. It is preferred to use from about 63 to about 77 volume percent of at least one solid carbonaceous material in said process, and it is more preferred to use from about 66 to about 73 volume percent of said solid material.

The carbonaceous solid can be comprised of one or more fractions of carbonaceous material. Thus, with reference to coal, e.g., the carbonaceous solid used in this process of this invention can be (1) one coal consist, or (2) a blend of several different coal consists. As used herein and in the prior art, the term "consist" means the particle size distribution of the solid phase of the coal-water slurry. For example, the term "8 mesh×0" indicates coal with a graded size, or consist, of coal particles distributed in the range of 8 mesh and zero (dust). Thus, the term "about 1180 microns×0.05 microns" indicates coal with a graded size, or consist, in the range of from about 1180 microns to about 0.05 microns.

In one embodiment of the process of this invention, a single consist of carbonaceous material is mixed with carrier liquid. In this embodiment, from about 60 to about 80 volume percent of said single consist of carbonaceous material is mixed (such as, e.g., by grinding) with from about 0.01 to about 4.0 weight percent of dispersing agent (based upon the weight of the dry carbonaceous material) and the carrier liquid until a slurry with the properties described above is obtained. In this embodiment, it is preferred that the mixing method used be grinding and that the solids-liquid mixture be ground in either a tumbling mill and/or a non-rotary ball or bead mill selected from the group consisting of ball mills and stirred ball mills. When a ball mill is used to grind the mixture, it is preferred that the ball mill be run at a reduced speed. In this embodiment, the mixture is ground at said high solids content of from about 66 to about 77 volume percent of coal and at a ball mill speed of from about 50 to about 70 percent of the ball mill critical speed. The critical speed of the ball mill is the theoretical speed at which the centrifugal force on a ball in contact with the mill shell at the height of its path equals the force on it due to gravity, and it is defined by the equation $$N_c=(76.6/D)$$

wherein $N_c$ is the critical speed (in rpm), and D is the diameter of the mill (feet) for a ball diameter that is small with respect to the mill diameter. A description of tumbling mills, such as ball mills, appears on pages 8–25 to 8–29 of the Fifth Edition of the *Chemical Engineers' Handbook*" (edited by Perry and Chilton, McGraw Hill, New York 1973).

In another embodiment of the process of this invention, at least two consists of carbonaceous material are mixed with carrier liquid. Both of said consists of carbonaceous material can be produced by wet grinding; thus, e.g., one of the consists can be produced by grinding coal at a high solids content (60–80 volume percent) in the presence of water and surfactant, the second of the consists can be produced by grinding coal at a lower solids content (30–60 volume percent) in a ball mill or a stirred ball mill, and the first and the second coal consists can be ground together with each other (and, optionally, with one or more additional consists produced by wet and/or dry grinding) at a solids content of from about 60 to about 80 volume percent in the presence of from about 0.01 to about 4.0 weight percent of dispersant and water to produce one of the stable slurries of this invention. Both of said consists of carbonaceous material can be produced by dry grinding; thus, e.g., one of the consists can be prepared by grinding one pulverized coal (i.e., coal which has been milled or ground to a consist of about 40 mesh by 0) in, e.g., a ring roller mill, a second or more of the consists can be prepared by dry grinding a second pulverized coal in, e.g., a micronizer fluid energy (jet) mill, and the two ground dry fractions are then blended in a blending tank at a solids concentration of from 60–90 volume percent with water and 0.01 to 4.0 weight percent of dispersant at a high shear stress in a mixer such as Greerco in-line mixer. At least one of said consists can be produced by wet grinding and at least one of said consists can be produced by dry grinding; thus, e.g., one of the consists can be produced by wet grinding coal at a low solids content (30–60 volume percent) in the presence of water and dispersant, a second of the consists can be produced by dry grinding pulverized coal in either a micronizer fluid energy (jet) mill, or a ring roller mill, and the consists produced by wet and dry grinding are then blended in a blending tank at a solids concentration of 60–80 volume percent with water and 0.01 to 4.0 weight percent of dispersant at a high shear stress in a mixer such as a Greerco in-line mixer. It will be apparent to those skilled in the art there are many other arrangements wherein two consists of carbonaceous material are mixed with carrier liquid to produce the slurry of this invention; they are intended to be within the scope of the invention.

In yet another embodiment of the process of this invention a single consist of carbonaceous material produced by dry grinding is mixed with carrier liquid and dispersant. Thus, e.g., coke can be dry ground in a ball mill, and the ground coke can be mixed in a high shear blender (such as, e.g., a Greerco in-line mixer) at a solids content of 60–80 volume percent with liquid and 0.01 to 4.0 weight percent of dispersant.

Figure 2:
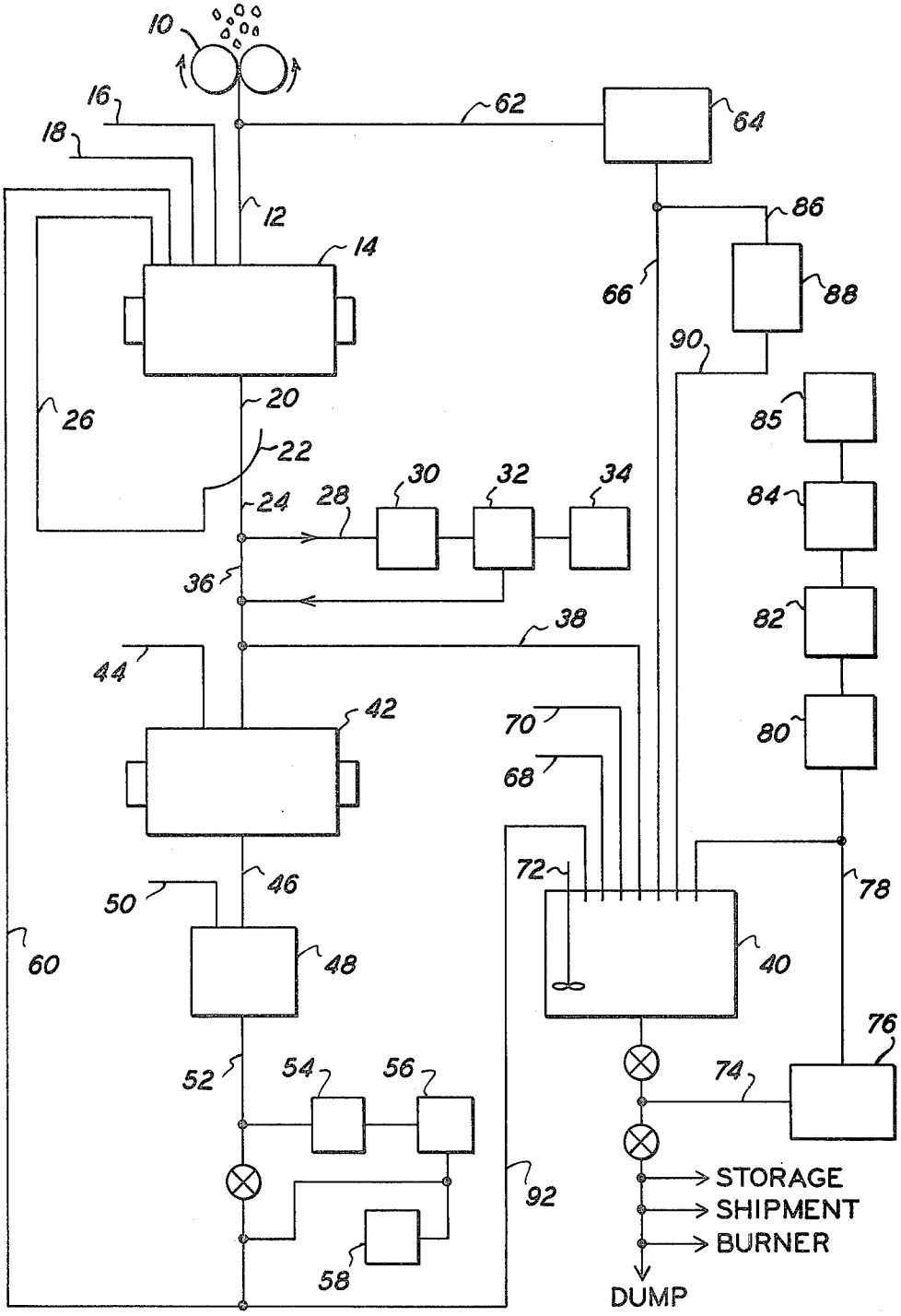
FIG. 2 is a flow sheet of a preferred process for preparing a carbonaceous slurry.

Several typical means of practicing the process of applicant's invention are illustrated in FIG. 2.

The description of the process of FIG. 2 will refer to coal (as the carbonaceous material) and water (as the liquid in the carbonaceous material-liquid mixtures. It is to be understood, however, that other carbonaceous material(s) and/or other liquid(s) can be used in said process. In a wet grinding method, coal is charged to crusher 10. Any of the crushers known to those skilled in the art to be useful for crushing coal can be used as crusher 10. Thus, by way of illustration and not limitation, one can use, e.g., a rod mill, a gyratory crusher, a roll crusher, a jaw crusher, a cage mill, and the like. Generally, the coal is crushed to a size of about $\frac{1}{4}'' \times 0$, although coarser and finer fractions can be used.

The crushed coal is fed through line 12 to mill 14. Mill 14 can be either a tumbling mill (such as a ball mill, pebble mill, rod mill, tube mill, or compartment mill) or a non-rotary ball or bead mill. Liquid (such as water) and diluted dispersing agent are fed through lines 16 and 18, respectively, to mill 14.

The mill 14 will have sufficient coal and liquid fed to it so that it will contain from about 60 to about 82 volume percent of coal. Generally, one should charge from about 0 to about 10 volume percent more coal to mill 14 then he desires in the final slurry product, subject to the qualification that in no event should more than 82 volume percent of coal be charged to the mill.

In general, less than about 40 volume percent of liquid and from about 0.01 to about 4.0 weight percent of dispersant (based on weight of dry coal) will be fed in lines 16 and 18, respectively, to mill 14. However, no more than from about 10 to about 90 weight percent of the optimum amount of dispersing agent is fed through line 18 to the mill, and it is fed in at least two separate portions at at least two separate times during the grinding.

When mill 14 is a ball mill, it is preferred to run it as less than about 70 percent of its critical speed. It is more preferred to run ball mill 14 at less than about 60 percent of its critical speed. It is more preferred to run ball mill 14 at less than about 55 percent of its critical speed. In one of the most preferred embodiments, ball mill 14 is run at less than about 52 percent of its critical speed.

Ground slurry from mill 14 is passed through line 20 through sieve 22. Sieve 22 may be 40 mesh sieve which allows underflow slurry of sufficient fineness (less than 420 microns) through to line 24; overflow particles which are greater than 420 microns are recycled via line 26 back into mill 14 wherein they are subjected to further grinding.

A portion of the underflow slurry from line 24 flows through line 28, viscometer 30, density meter 32, and particle size distribution analyzer 34; the remaining portion of the underflow slurry flows through line 36.

Any of the viscometers known to those skilled in the art can be used as viscometer 30. Thus, by way of illustration, one can use a Nametre Viscometer. The viscometer 30 indicates the viscosity of the ground slurry. If the viscosity of the ground slurry is higher than desired, then either mill 14 is not grinding the coal to produce a sufficiently high surface area, and low porosity, and/or the amount or type of dispersing agent used is insufficient to produce a sufficiently high zeta potential on the colloidal coal particles; and the underflow slurry should be subjected to further tests (in density meter 32 and particle size distribution aanalyzer 34).

Any of the density meters known to those skilled in the art can be used as density meter 32. Density meter 32 indicates the density of the underflow slurry, which directly varies with its solids content. If the density of the underflow slurry is lower or higher than desired, then it is possible that the particle size distribution of the coal compact in the underflow slurry is lower or higher than desired. In this case, the underflow slurry should be subjected to further tests in particle size analyzer 34 to determine what the particle size distribution of the underflow slurry is and its attendant surface area and porosity.

Particle size distribution analyzer 34 analyzes the particle size distribution of the compact of the underflow slurry. Any of the particle size distribution analyzers known to those skilled in the art, such as, e.g., Micromeritics Sedigraph 5500L, Coulter Counter, Leads and Northrup Microtrac Particle Analyzers, can be used as analyzer 34. From the data generated by analyzer 34 the specific surface area and the porosity of the compact of underflow slurry can be determined.

If the solids content, the viscosity, the specific surface area, and the porosity properties of the underflow slurry are as desired, then the underflow slurry is passed through line 38 to final trim tank 40. If, however, either the solids content, the viscosity, the specific surface area, or the porosity property of the underflow slurry is not as desired, then a portion of underflow slurry is passed through line 36 to mill 42. Depending on how badly the underflow slurry is out of specification, from about 1 to about 30 volume percent of the underflow slurry is passed to mill 42 and the remainder is passed to trim tank 40. Recycling the slurry to mill 42 and, after regrinding, to mill 14, increases the quality of the slurry coming out of mill 14.

Mill 42 can be either a tumbling mill (such as a ball mill) or a non-rotary ball or bead mill (such as a stirred ball mill). When mill 42 is a ball mill, it is preferred to run it at less than about 70 percent of its critical speed and, more preferably, at less than about 60 percent of its critical speed; in the most preferred embodiment, when mill 42 is a ball mill it is run at less than about 55 percent of its critical speed.

Water is fed into mill 42 through line 44 so that the solids concentration of the ground slurry fed through line 36 will be adjusted to about 30 to about 60 volume percent. The diluted slurry in mill 42 is then ground in mill 42 until at least about 95 volume percent of the particles in the slurry have diameters less than about 20 microns. It is preferred to grind the slurry in mill 42 until at least 95 volume percent of the particles in the slurry are smaller than 15 microns and, more preferably, 10 microns. In the most preferred embodiment, the diluted slurry in mill 42 is ground until at least about 95 volume percent of the particles in the slurry have diameters less than about 5 microns.

The slurry ground in mill 42 is then passed through line 46 to high shear mixer 48. Any of the high-shear, high-intensity mixers known to those skilled in the art can be used as mixer 48; thus, e.g., the mixers described on page 19–7 of Perry and Chilton's *Chemical Engineer's Handbook,* Fifth Edition, supra, can be used.

Dispersing agent can be passed through line 50 to high shear mixer 48 in order to optimize the zeta potential of the colloidal particles in the slurry. However, the amount of dispersant added in line 50 should be such that the total amount added in lines 18 and 50 does not exceed from about 10 to about 90 weight percent of the optimum amount of dispersant.

In general, the ground slurry can be mixed with water and dispersant in mixer 48 for from about 3 to about 15 minutes and, preferably, for about 10 minutes. The mixture from mixer 48 to then passed through line 52 and through viscometer 54, density meter 56, and particle size distribution analyzer 48. If the properties of the mixed slurry from mixer 48 are not suitable, then the water flow to mill 42 through line 44 and/or the slurry flow to mill 42 through line 36 and/or the dispersant flow to mixer 48 through line 50 are adjusted until the properties are suitable. If the properties of the mixed slurry from mixer 48 are suitable, then the mixed slurry is recycled to trim tank 40 or to mill 14 through line 60 where it is mixed with and ground with crushed coal from line 12, water from line 16, and dispersant from line 18.

FIG. 2 also illustrates a dry grinding process for making the stabilized slurry of this invention. In this alternative process, crushed solid material, such as coke, from crusher 10 is passed through line 62 to dry grind 64, where it is dry ground. Any dry grinder known to those skilled in the art can be used. Thus, by way of example, one can use ball mills or the ring roller mills described on pages 8–33 and 8–34 of Perry and Chilton's *Chemical Engineer's Handbook,* Fifth Edition, supra. The crushed material is ground in grinder 64 until it is pulverized, that is until it is a consist of about 40 mesh×0.

The ground carbonaceous material from dry grinder 64 is passed through line 66 to trim tank 40. Water and dispersing agent are passed through lines 68 and 70, respectively, to trim tank 49. The total amount of dispersant added to trim tank 40 from line 68 and/or line 38 and/or line 92 should not exceed from about 10 to about 90 weight percent of the optimum dispersant concentration, and it should be added in at least two stages at at least two separate times. The carbonaceous material/water/dispersant mixture is stirred by stirrer 72, and the stirred mixture is passed through line 74 to high shear mixer 76. Any of the high-shear mixers described above can be used as mixer 76. The quality of the slurry produced in mixer 76 is evaluated by passing it through line 78 to zeta potential analyzer 80, particle size distribution analyzer 82, Haake viscometer 84, (for measuring yield stress), and density meter 86. If the net zeta potential of the colloidal particles in the slurry is from about 10 to about 90 millivolts, the solids content is from about 60 to 80 volume percent, the yield stress is from about 3 to about 18 Pascals, the surface area is from about 0.8 to about 4 $m^2$/cc, the porosity is less than 20 volume percent, and the compact in the slurry is described by the aforementioned equations, then the slurry produced by the dry grinding is satisfactory. However, if the slurry is not up to specifications, then a portion of the ground material from line 66 is passed through line 86 to be dry ground in a micronizer fluid energy (jet) mill. The fine particles from jet mill 88 are passed through line 90 to trim tank 40 where they are mixed with the ground material from line 66, the water from line 68, and the dispersant from line 70. Thereafter, the slurry produced in trim tank 40 is again evaluated in zeta potential analyzer 80, particle size distribution analyzer 82, Haake viscometer 84, and density meter 85 to determine whether the slurry is up to specifications. The process can be fine-tuned by this method until the properties of the slurry are as required; alternatively or additionally, one can alter the rate of flow of water and surfactant through lines 68 and 70, respectively, the rate of flow of material from line 66 (by varying the speed of the mill and/or the rate at which crushed material is fed to the mill through line 62), and the like. Alternatively, ground material from dry grinders can be fed directly back to mills 14 or 42 and as feed for the wet grinding circuits.

In yet another method illustrated in FIG. 2, the amount of very finely ground slurry material in trim tank 40 can be increased by passing a portion of the mixed slurry from high speed mixer 48 through line 92 into trim tank 40. Alternatively, or additionally, the amount of moderately finely ground slurry material in trim tank 80 can be increased by passing a portion of the ground slurry from ball mill 14 through line 38 to slurry tank 40. This scheme allows various fractions of slurries from wet grinders 14 and 42 to be blended with various fractions of dry consist from dry grinders 64 and 88.

In practice of the invention, it is preferred that addition of any electrolytes and/or surfactants or other dispersing agents be carried out as grinding mill additives during preparation of the coal compact.

The agents maintain a low slurry viscosity during grinding. Furthermore, the agents are immediately available for adsorption of the new surfaces generated during comminution of the coal. Accordingly, need for later treatment with chemical ion species on the surfaces is minimized or eliminated, thereby saving time, energy, and materials cost.

The following examples are presented to illustrate the claimed invention but are not to be deemed limitative thereof. Unless otherwise stated, all parts are by weight and all temperatures are in degrees centigrade.

EXAMPLE 1

PROCEDURE FOR SCREENING AND SELECTING DISPERSING AGENTS

A surfactant or combination of surfactants effective for use in practicing the invention may be found by either of the two following methods.

(a) Zeta potential measurement.

In general, a sample of coal is ground in a laboratory size porcelain ball mill with porcelain balls in water at 30 wgt. % solids for approximately 24 hours to insure that all the particles are <10 um. Small samples of this larger sample are then prepared in a known way by placing them in a vessel equipped with a stirrer with a sample of water to be used as a carrier. Various acidic and basic salts are then added in incremental amounts to vary the pH, and various concentrations of various candidate dispersing agent organic surfactants likewise are added in incremental amounts (e.g. grams per gram coal, both dry basis), alone or in combinations of two or more. These samples are then evaluated in any electrophoretic mobility, electrosomosis, or streaming potential apparatus to measure electrical potentials, from which the zeta potential is calculated in a known way. Plots of zeta potential vs pH vs concentration may then be made to indicate candidate surfactants, or combinations thereof to be used to produce the optimum dispersion of coal particles in the carrier water below the amount at which dilatency may be reached. A Pen Kem System 3000 apparatus is used in the determination described and can process 40 samples in about 6 hours.

(b) Alternate method for estimating equivalent zeta potential.

A large sample of coal is ground in water as described in (a) above at 50 wgt. % solids for about 24 hours to produce a slurry.

Smaller samples, about 500 ml, of this slurry are then deflocculated by adding various candidate dispersing agent surfactants and surfactant combinations to the sample of slurry, as above, dry or, preferably, in solution, dropwise, blending gently, and then measuring the viscosity at some constant shear rate (e.g., using a Brookfield LVT viscometer at 30 rpm). A surfactant system which is found to produce an acceptably low, preferably the lowest, viscosity at the lowest amount, e.g. in wgt. % of addition on a dry coal basis is thereby identified as the most effective surfactant.

EXAMPLE 2

PREPARATION OF COAL SAMPLES FOR MEASUREMENTS (a) Sieve analysis.

Although any standard procedure may be used to measure particle sizes of coal particles from a coal and then to calculate the particle size distribution, the procedure used in obtaining data discussed herein will be described.

A weighed sample, e.g. 50 grams dry wgt. of coal is dispersed in 400 ml of carrier water containing 1.0 wgt. % Lomar D based on a weight of coal, dry basis, and the slurry is mixed for 10 minutes with a Hamilton Beach mixer. The sample is then allowed to stand quiescent for 4 hours, or preferably, overnight. (This step usually is not necessary if the slurry was milled with surfactant).

The sample is then remixed very briefly. It then is poured slowly on a stack of tared U.S. Standard sieves over a large vessel. The sample is carefully washed with running water through the top sieve with the rest of the stack intact until all sievable material on that sieve is washed through the sieve into the underlying sieves. The top sieve is then removed and each sieve in the stack, as it becomes the top sieve, is successively washed and removed until each sieve has been washed. The sieves are then dried in a dryer at 105° C. and the residue on each is weighed in a known way.

(b) Sedigraph analysis.

A separate sample finer than 140 mesh sieve size is carefully stirred and a representative sample (about 200 ml) is taken for analysis. The rest may be discarded.

About 2 eyedroppers of the dilute slurry are further diluted in 30 ml of distilled water with 4 drops of Lomar D added. This sample is stirred overnight with a magnetic stirrer. Measurement is then made with the Sedigraph 5500L.

The Sedigraph 5500L uses photo extinction to measure particles. It essentially measures projected area of shadows and the data must be converted to volume-%-finer-than. The data from the sieve and Sedigraph is combined to prepare a CPFT chart. $D_s$ at 1% is read from the CPFT line.

COMPARATIVE EXAMPLE 3

To an Abbe ball mill were charged 16.3 pounds of a 4×0 mesh Pittston Moss #1 coal with a Hardgrove grindability index of about 72 and a free swelling index of about 7, 4.6 pounds of water, 3.7 grams (0.05 weight percent, by weight of dry coal) of sodium hydroxide, and 51.8 grams (0.7 weight percent, by weight of dry coal) of "Lomar D" (the sodium salt of a condensed alkyl mononaphtalene sulfonic acid sold by the Diamond Shamrock Process Chemicals, Inc. of Morristown N.J.); the grinding mixture thus formed contained 78 weight percent of coal. The Abbe ball mill used was model number 2 and was manufactured by the Paul O. Abbe Company of Little Falls, N.J.; the ball mill had 35 volume percent ball charge of 2.0 inch top Bond ball mix.

The ball mix was run at a speed of 34 revolutions per minute, which corresponded to 51 percent of its critical speed, for about 130 minutes until at least about 99.34 weight percent of the coal particles in the grinding mixture were smaller than 50 mesh (297 microns). A sample of the slurry produced was diluted to a solids content of 75 weight percent, and its Brookfield viscosity was tested at 100 revolutions per minute on a Brookfield RVT viscometer manufactured by Brookfield Engineering Laboratories, Inc., of Stoughton, Mass.). The Brookfield viscosity of the slurry was 1100 centipoise.

EXAMPLE 4

The procedure of Example 3 was substantially followed, with the exception that only 25.2 grams (0.34 weight percent, by weight of dry coal) of "Lomar D" was used, and portions of the Lomar D used were added throughout the grinding cycle to the mill. Table 1 shows how the Lomar D was added in this Experiment.

TABLE 1

| Weight Percent of Dispersing Agent Added to the Abbe Mill | Time at which the Addition of the Dispersing Agent to the Mill was made, Minutes |
|---|---|
| 0.02 | 0 |
| 0.04 | 5 |
| 0.035 | 10 |
| 0.02 | 15 |
| 0.025 | 20 |
| 0.07 | 25 |
| 0.095 | 30 |
| 0.06 | 35 |
| 0.045 | 40 |
| 0.03 | 45 |
| 0.03 | 50 |
| 0.03 | 55 |
| 0.03 | 60 |
| 0.03 | 65 |
| 0.03 | 70 |
| 0.03 | 75 |
| 0.03 | 80 |
| 0.03 | 85 |
| 0.03 | 90 |
| 0.03 | 95 |
| 0.03 | 100 |
| 0.03 | 105 |

TABLE 1-continued

| Weight Percent of Dispersing Agent Added to the Abbe Mill | Time at which the Addition of the Dispersing Agent to the Mill was made, Minutes |
|---|---|
| 0.03 | 110 |
| 0.03 | 115 |
| 0.03 | 120 |
| 0.06 | 125 |
| Total- 0.34 | |

98.02 weight percent of the coal particles in the slurry produced were finer than 50 mesh. The slurry had a Brookfield viscosity of 1150 centipoise at 75 weight percent of solids. Thus, despite the fact that less than about 50% of dispersing agent was used in this Example 4, a slurry was produced with substantially the same properties as that produced in Example 3.

EXAMPLE 5

The procedure of Example 4 was substantially followed. Only 25.2 grams (0.34 weight percent, by weight of dry coal) of Lomar D was used, and portions of Lomar D were added throughout the grinding cycle to the mill. Table 2 shows how the Lomar D was added during this Experiment.

TABLE 2

| Weight Percent of Dispersing Agent Added to the Abbe Mill | Time at which the Addition the Dispersing Agent to the Mill was made, Minutes |
|---|---|
| 0.02 | 0 |
| 0.125 | 10 |
| 0.045 | 20 |
| 0.165 | 30 |
| 0.105 | 40 |
| 0.60 | 50 |
| 0.60 | 60 |
| 0.60 | 70 |
| 0.60 | 80 |
| 0.60 | 90 |
| 0.60 | 100 |
| 0.60 | 110 |
| 0.60 | 120 |
| Total- 0.34 | |

96.77 weight percent of the coal particles in the slurry produced were finer than 50 mesh. The slurry had a Brookfield viscosity of 1200 centipoise at 75 weight percent of solids.

EXAMPLE 6

The procedure of Example 5 was substantially followed, with the exception that the addition schedule for the dispersing agent differed. Table 3 shows how the 0.34 weight percent of Lomar D was added.

TABLE 3

| Weight Percent of Dispersing Agent Added to the Abbe Mill | Time at which the Addition of the Dispersing Agent to the Mill was made, Minutes |
|---|---|
| 0.02 | 0 |
| 0.09 | 5 |
| 0.005 | 10 |
| 0.025 | 15 |
| 0.055 | 20 |
| 0.07 | 25 |
| 0.08 | 30 |
| 0.055 | 35 |
| 0.05 | 40 |
| 0.04 | 45 |
| 0.03 | 50 |
| 0.03 | 55 |
| 0.03 | 60 |

TABLE 3-continued

| Weight Percent of Dispersing Agent Added to the Abbe Mill | Time at which the Addition of the Dispersing Agent to the Mill was made, Minutes |
|---|---|
| 0.03 | 65 |
| 0.03 | 70 |
| 0.03 | 75 |
| 0.03 | 80 |
| 0.03 | 85 |
| 0.03 | 90 |
| 0.03 | 95 |
| 0.03 | 100 |
| 0.03 | 105 |
| 0.03 | 110 |
| 0.03 | 115 |
| 0.03 | 120 |
| 0.06 | 125 |
| Total- 0.34 | |

97.05 weight percent of the coal particles in the slurry produced were finer than 50 mesh. The slurry had a Brookfield viscosity of 960 centipoise at 75 weight percent of solids.

EXAMPLE 7

The procedure of Example 5 was substantially followed with the exception that the addition schedule for the dispersing agent differed. Table 4 shows how the 0.34 weight percent of Lomar D was added.

TABLE 4

| Weight Percent of Dispersing Agent Added to the Abbe Mill | Time at which the Addition of the Dispersing Agent to the Mill was made, Minutes |
|---|---|
| 0.02 | 0 |
| 0.095 | 10 |
| 0.08 | 20 |
| 0.15 | 30 |
| 0.105 | 40 |
| 0.07 | 50 |
| 0.06 | 60 |
| 0.06 | 70 |
| 0.06 | 80 |
| 0.06 | 90 |
| 0.06 | 100 |
| 0.06 | 110 |
| 0.06 | 120 |
| Total- 0.34 | |

97.62 weight percent of the coal particles in the slurry produced were finer than 50 mesh. The slurry had a Brookfield viscosity of 1170 centipoise at 75 weight percent of solids.

EXAMPLE 8

The procedure of Example 5 was substantially followed, with the exception that 16.7 grams (0.225 weight percent, by weight of dry coal) of Lomar D was used, and the addition schedule differed. Table 5 shows how the 0.225 weight percent of Lomar D was added.

TABLE 5

| Weight Percent of Dispersing Agent Added to the Abbe Mill | Time at which the Addition of the Dispersing Agent to the Mill was made, Minutes |
|---|---|
| 0.025 | 0 |
| 0.05 | 25 |
| 0.05 | 35 |
| 0.025 | 60 |
| 0.025 | 70 |
| 0.025 | 100 |
| 0.025 | 120 |

TABLE 5-continued

| Weight Percent of Dispersing Agent Added to the Abbe Mill | Time at which the Addition of the Dispersing Agent to the Mill was made, Minutes |
|---|---|
| 0.225 | |

94.39 weight percent of the coal particles in the slurry produced were finer than 50 mesh. The viscosity of the slurry was 1150 centipoise at a solids content of 75 weight percent.

Although these examples have described experiments utilizing Lomar D surfactant, similarly good results are obtainable with other surfactants.

It is to be understood that the foregoing description and Examples are illustrative only and that changes can be made in the ingredients and their proportions and in the sequence and combination of process steps as well as other aspects of the invention without departing from the scope and spirit of the invention as defined in the following claims.

I claim:

1. A process for preparing a carbonaceous slurry, comprising the steps of:

(a) providing a grinding mixture comprising from about 60 to about 82 volume percent of carbonaceous solid material and from about 18 to about 40 volume percent of carrier liquid;

(b) grinding said grinding mixture for a time sufficient to produce a carbonaceous slurry which:

1. comprises at least about 5 weight percent (by weight of said dry carbonaceous solid material) of colloidal particles of carbonaceous material which are smaller than about 3 microns;
2. comprises from about 60 to about 82 volume percent of dry carbonaceous solid material and from about 18 to about 40 volume percent of carrier liquid;
3. has a Brookfield viscosity of less than 5,000 centipoise when the slurry is tested at a solids content of 60 volume percent, a shear rate of 100 revolutions per minute, and under ambient temperature and pressure conditions;
4. has a yield stress of from about 3 to about 18 Pascals;
5. contains a consist of finely-divided carbonaceous particles dispersed in said slurry wherein said consist has a specific surface area of from about 0.8 to about 4.0 square meters per cubic centimeter and an interstitial porosity of less than 20 volume percent, and wherein said consist has a particle size distribution substantially in accordance with the following formula:

$$\frac{CPFT}{100} = \sum_{j=1}^{k}\left[X_j\left(\frac{D^{Nj} - D_{sj}^{Nj}}{D_{Lj}^{Nj} - D_{sj}^{Nj}}\right)\right]$$

where $\sum_{j=1}^{k} X_j = 1.0$ and where if $D < D_{sj}$ $\left(\frac{D^{Nj} - D_{sj}^{Nj}}{D_{Lj}^{Nj} - D_{sj}^{Nj}}\right) = 0.0$ -continued and where if $D > D_{Lj}$ $\left(\frac{D^{Nj} - D_{sj}^{Nj}}{D_{Lj}^{Nj} - D_{sj}^{Nj}}\right) = 1.0$ wherein:

(a) CPFT is the cumulative percent of said solid carbonaceous material finer than a certain specified particle size D, in volume percent;

(b) k is the number of component distributions in the consist and is at least 1;

(c) $X_j$ is the fractional amount of the component j in the consist, is less than or equal to 1.0, and the sum of all of the $X_j$'s in the consist is 1.0;

(d) n is the distribution modulus of fraction j and is greater than about 0.001;

(e) D is the diameter of any particle in the consist and ranges from about 0.05 to about 1180 microns;

(f) Ds is the diameter of the smallest particle in fraction j, as measured at 1% CPFT on a plot of CPFT versus size D, is less than $D_L$, and is greater than 0.05 microns;

(g) $D_L$ is the diameter of the size modulus in fraction j, measured by sieve size or its equivalent, and is from about 15 to about 1180 microns.

(c) during the grinding of said grinding mixture, adding a total of from about 10 to about 90 weight percent of the optimum amount of dispersing agent to the grinding mixture by adding at least two separate portions of the dispersing agent at at least two separate times.

2. The process as recited in claim 1, wherein said k is 1.

3. The process as recited n claim 2, wherein said liquid is water.

4. The process as recited in claim 3, wherein said colloidal sized particles of carbonaceous material have a net zeta potential of from about 15 to about 85 millivolts.

5. The process as recited in claim 4, wherein during the grinding of said grinding mixture, a total of from about 20 to about 80 weight percent of the optimum amount of dispersing agent is added to the grinding mixture by adding at least three separate portions of the dispersing agent at at least three separate times.

6. The process as recited in claim 5, wherein the concentration of solid carbonaceous material in said slurry, the interstitial porosity of said consist, the specific surface area of said consist, and the zeta potential of said colloidal size particles of solid carbonaceous material are interrelated in accordance with the following formula:

$$V_s + P_s + SA + \frac{240}{ZP} = H$$

wherein:

(a) $V_s$ is the percent, by volume, of solid carbonaceous material in said slurry;

(b) P is the porosity of said consist in the slurry, in percent;

(c) S.A. is the specific surface area of said consist in said slurry, in square meters per cubic centimeter;

(d) Z.P. is the net zeta potential of said colloidal size particles of carbonaceous material in said consist, in millivolts, and (e) H is from about 75 to about 98.

7. The process as recited in claim 6, wherein said solid carbonaceous material is coal.

8. The process as recited in claim 7, wherein a total of from about 30 to about 70 weight percent of the optimum amount of dispersing agent is added to the grinding mixture.

9. The process as recited in claim 8, wherein a total of from about 40 to about 60 weight percent of the optimum amount of dispersing agent is added to the grinding mixture by adding at least four separate portions of the dispersing agent at at least four separate times.

10. The process as recited in claim 9, wherein a total of from about 45 to about 55 weight percent of the optimum amount of dispersing agent is added to the grinding mixture.

11. The process as recited in claim 1, wherein said carrier liquid is comprised of at least about 90 weight percent of water and less than about 10 weight percent of petroleum liquid.

12. The process as recited in claim 1, wherein said carbonaceous solid is comprised of at least two carbonaceous consists.

13. The process as recited in claim 1, wherein said grinding mixture is ground in a ball mill.

14. The process as recited in claim 13, wherein said ball mill grinding is conducted at less than about 70 percent of the ball mill critical speed.

15. The process as recited in claim 1, wherein said carbonaceous solid material is petroleum coke.

16. The process as recited in claim 12, wherein at least one of said carbonaceous consists is produced by wet grinding.

17. The process as recited in claim 12, wherein said carbonaceous consists are coal consists.

18. The process as recited in claim 11, wherein said carbonaceous solid is comprised of at least two carbonaceous consists.

19. The process as recited in claim 18, wherein said carbonaceous consists are coal consists.

* * * * *